United States Patent [19]

Rubin

[11] 4,100,096

[45] Jul. 11, 1978

[54] CLEANER FOR HYDROPHILIC METAL SURFACES OF LITHOGRAPHIC DUPLICATORS

[75] Inventor: Jack C. Rubin, Westchester, Ill.

[73] Assignee: Addressograph Multigraph Corp., Cleveland, Ohio

[21] Appl. No.: 692,894

[22] Filed: Jun. 4, 1976

[51] Int. Cl.[2] ..... C11D 3/14; C11D 7/08; C23G 1/02

[52] U.S. Cl. ..... 252/145; 134/3; 134/7; 134/41; 252/142; 252/313 R

[58] Field of Search ..... 134/3, 7, 41, 42; 252/89, 128, 136, 140, 142, 145, 155, 173, 313 R

[56] References Cited

U.S. PATENT DOCUMENTS

| | | | |
|---|---|---|---|
| 2,763,620 | 9/1956 | Bugosh | 252/313 |
| 2,816,079 | 12/1957 | White | 252/317 |
| 2,937,149 | 5/1960 | Hilton | 252/136 |
| 3,105,053 | 9/1963 | Cramer et al. | 252/313 |
| 3,133,886 | 5/1964 | Zisman et al. | 252/354 |
| 3,275,560 | 9/1966 | Wasserman et al. | 252/101 |
| 3,325,415 | 6/1967 | Kenney et al. | 252/144 |
| 3,330,769 | 7/1967 | Golben et al. | 252/136 |
| 3,458,300 | 7/1969 | Duvall et al. | 51/308 |
| 3,553,016 | 1/1971 | Foelsch | 134/3 |
| 3,709,823 | 1/1973 | Sugahara et al. | 252/136 |
| 3,961,982 | 6/1976 | Delorenzo | 134/3 |
| 3,964,913 | 6/1976 | Nighy | 106/10 |
| 4,032,466 | 6/1977 | Orthalek et al. | 252/136 |

FOREIGN PATENT DOCUMENTS

| | | |
|---|---|---|
| 956,927 | 4/1964 | United Kingdom. |

*Primary Examiner*—P.E. Willis, Jr.
*Attorney, Agent, or Firm*—M. A. Kondzella; S. L. Goldstein

[57] ABSTRACT

Hydrophilic surfaces on lithographic duplicators are cleaned by light rubbing with a liquid composition comprising levigated alumina of small particle size, a surfactant, an aluminum salt and an acidifying agent all dispersed in water. The surface is then rinsed with water to remove the cleaning composition, and is found to be in an ink-free moisture receptive condition.

5 Claims, No Drawings

CLEANER FOR HYDROPHILIC METAL SURFACES OF LITHOGRAPHIC DUPLICATORS

BACKGROUND OF THE INVENTION

This invention relates to lithographic duplicators and particularly to the removal of ink from portions of lithographic duplicating machines. On lithographic duplicators, certain parts of the equipment, for instance the master cylinder and impression cylinders of rotary machines are brought regularly into contact with lithographic printing ink so that, in use, they become stained and require cleaning.

When the ink has partially dried in place it attaches itself quite firmly to whatever surface it finds itself upon and is very difficult to remove. This is especially true with surfaces of anodized aluminum among others but is a problem, to a certain extent, even with polished chromium plated surfaces.

If these surfaces are to function properly they must remain hydrophilic and basically ink-rejecting when wet, and to maintain them in this condition, regular, careful removal of ink stains and residues is essential.

Heretofore various types of cleaning solutions employing principally water dispersible acidic cleaners and the like have been used, but with only modest success, because the dried ink deposits are not found to respond to this kind of treatment except when applied with a great deal of vigor on the part of the user.

It has therefore become a matter of some concern to find a suitable cleaning compound which can be used on lithographic duplicators to clean the surfaces in question in short periods of time and without excessive effort.

SUMMARY OF THE INVENTION

It has been discovered that by preparing a liquid composition comprising an aqueous vehicle and a compatible surfactant in which is dispersed very finely divided levigated alumina, it is possible to clean the surfaces in question with a minimum of effort even in difficult situations such as where the ink stain appears to have been accepted into the pores of the surface layer.

DESCRIPTION OF THE PREFERRED EMBODIMENT

The composition which serves as the cleaning agent for the lithographic duplicator parts includes essentially levigated alumina of a fairly high degree of purity and with a particle size of 25 microns or less. Preferably the particle size should be less than 15 microns, and in any case no more than about 50% should be less than about five microns. The alumina is dispersed in an aqueous vehicle, largely water, but including a small percentage of a compatible surfactant which allows the composition to wet the surface to be cleaned so that the alumina is carried to the locations where its action is required. The alumina is present in a range of about 6 percent to 25 percent by weight of the overall composition.

The composition also benefits by inclusion of one or more readily ionizable water soluble aluminum salts and acidic components which were commonly used in cleaners of this type heretofore on the market, such as aluminum sulfate and an acid. The aluminum salts have the effect of maintaining the water receptive character of the metal surfaces (particularly of aluminum surfaces) and the acid is included as a cleaning agent to remove miscellaneous deposits from the metal surfaces.

In the present case the acid also, by being present in an amount sufficient to maintain a pH in the range of 0.65 to 0.75, provides an environment in which the very fine alumina is prevented from agglomerating. The aluminum salt is generally used in a concentration range between about 8 percent and 15 percent by weight of the overall composition, or in any case preferably less than about one-third of the total weight of water and salt.

The surfactant is provided in very minor percentages, for example 0.25 percent or less by weight of the overall composition, depending upon the type of surfactant used, and is water soluble or miscible as well as stable in an acid medium. The surfactant must be anionic or nonionic, preferably the latter, and cannot be cationic. For convenience, this property is referred to herein as non-cationic, and when used in the subjoined claims will be understood to have this significance. Various surfactants meet these requirements, and any such will be suited to preparation of the composition. The surfactants at present preferred are fluorocarbon products prepared by DuPont de Nemours & Co., especially Zonyl FSN, and napthalene sulphonates such as Aerosol OS, a product of American Cyanamid Co.

When the ingredients are mixed in accordance with standard compounding procedures, the result is a liquid which can be rubbingly applied to the metal surface to be cleaned by means of a sponge or pad, and which can be easily removed by rinsing with water to leave a clean surface which is preferentially hydrophilic and free of any cleaning composition or any fraction thereof.

The alumina in the composition does not remain long in dispersion, but gradually settles to the bottom of the container. It can be readily redispersed by a brief period of agitation, and is, of course, maintained in dispersion by agitation during the process of filling containers to maintain correct concentration.

When this mixture is applied to the ink deposits and stains on metal parts of lithographic duplicators, and rubbed lightly, the ink is quickly removed and very little effort is required.

As examples of the compositions which, in accordance with the present invention, may be employed successfully in the removal of ink from the metal parts of lithographic duplicators, the following are cited:

EXAMPLE I

Levigated alumina is dispersed in a water base composition in an amount which constitutes from about 6 percent to about 25 percent by weight of the overall composition. The composition also includes a non-cationic water miscible surfactant in an amount constituting from about 0.02 to about 0.25 by weight of the composition. A readily ionizable aluminum salt is also dissolved in the composition and may constitute about 8 to 15 percent by weight of the total. In any case, the aluminum salt or salts preferably constitute a proportion of the water-salt mixture, less than one-third by weight.

Sufficient mineral acid is added to give to the resulting liquid a pH value of between about 0.65 and about 0.75.

| Example II | Approximate Percent by Weight |
|---|---|
| One specific example of the preferred form of the composition is as follows: | |
| Levigated alumina of particle size | |

-continued

| Example II | Approximate Percent by Weight |
|---|---|
| less than 15 microns and no more than 50% being less than 5 microns | 16.25 |
| Fluorocarbon surfactant solution (50% solids) (e.g. Dupont Zonyl FSN) | 0.1 |
| Aluminum sulfate | 11.6 |
| Concentrated nitric acid | 3.25 |
| Water | Balance |

What is claimed is:

1. The process of cleaning lithographic ink deposits from metal surfaces of a lithographic duplicator which comprises rubbing the surface to be cleaned with a composition consisting essentially of an aqueous dispersion containing about 6 percent to 25 percent by weight of levigated alumina of particle size smaller than 25 microns, about 0.02 percent to 0.25 percent by weight of a water miscible, acid stable, non-cationic surfactant, about 8 percent to 15 percent by weight of aluminum sulfate and an acid present in an amount sufficient to maintain the pH of the dispersion in the range of 0.65 to 0.75, and thereafter removing from the cleaned surface any residue of said composition.

2. A process as set forth in claim 1 in which the levigated alumina includes only particles smaller than 15 microns, of which no more than half are smaller than 5 microns.

3. A composition for cleaning the hydrophilic metal surfaces of lithographic duplicators consisting essentially of an aqueous dispersion containing about 6 percent to 25 percent by weight of levigated alumina of particle size smaller than 25 microns, about 0.02 percent to 0.25 percent by weight of a water miscible, acid stable, non-cationic surfactant, about 5 percent to 15 percent by weight of aluminum sulfate and an acid present in an amount sufficient to maintain the pH of the dispersion in the range of 0.65 to 0.75.

4. A composition according to claim 3 wherein the levigated alumina includes only particles smaller than 15 microns, of which no more than half are smaller than 5 microns.

5. A composition according to claim 4 wherein the levigated alumina is present in about 16.25 percent by weight of the composition, the surfactant about 0.05 percent, the aluminum sulfate about 11.6 percent and concentrated nitric acid about 3.25 percent.

* * * * *